US007845992B2

(12) United States Patent
Glick et al.

(10) Patent No.: US 7,845,992 B2
(45) Date of Patent: Dec. 7, 2010

(54) ELECTRICAL CONNECTOR WITH CONTACT ARM PRELOADING

(75) Inventors: Michael S. Glick, Farmington Hills, MI (US); Willie R. Lyons, West Bloomfield, MI (US); Cecil Brown, Canton, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 12/350,487

(22) Filed: Jan. 8, 2009

(65) Prior Publication Data

US 2009/0197479 A1 Aug. 6, 2009

Related U.S. Application Data

(60) Provisional application No. 61/063,276, filed on Jan. 31, 2008.

(51) Int. Cl.
*H01R 13/187* (2006.01)

(52) U.S. Cl. ..... 439/843

(58) Field of Classification Search ..... 439/843, 439/857, 636, 637
See application file for complete search history.

(56) References Cited

U.S. PATENT DOCUMENTS

| | | | | | |
|---|---|---|---|---|---|
| 3,737,838 | A | * | 6/1973 | Mattingly et al. | 439/634 |
| 4,072,394 | A | | 2/1978 | Waldron et al. | 339/276 T |
| 4,169,654 | A | | 10/1979 | Plyler et al. | 339/252 P |
| 4,217,024 | A | * | 8/1980 | Aldridge et al. | 439/381 |
| 4,274,699 | A | * | 6/1981 | Keim | 439/637 |
| 4,359,258 | A | | 11/1982 | Palecek et al. | 339/176 MP |
| 4,437,726 | A | | 3/1984 | Lambert | 339/252 P |
| 4,591,230 | A | | 5/1986 | Roldan | 339/258 |
| 5,108,318 | A | | 4/1992 | Sakurai et al. | 439/744 |
| 5,199,910 | A | | 4/1993 | Kahle et al. | 439/843 |
| 5,334,053 | A | | 8/1994 | Noschese | 439/682 |
| 5,399,108 | A | * | 3/1995 | Lu et al. | 439/682 |
| 5,609,502 | A | | 3/1997 | Thumma | 439/747 |
| 5,775,960 | A | * | 7/1998 | Saito et al. | 439/843 |
| 5,897,404 | A | | 4/1999 | Goodman et al. | 439/843 |
| 5,938,487 | A | | 8/1999 | Henry et al. | 439/857 |
| 6,152,775 | A | | 11/2000 | Pavlovic | 439/620 |
| 6,371,772 | B1 | | 4/2002 | Yoneyama et al. | 439/79 |
| 6,799,999 | B2 | | 10/2004 | Williamson et al. | 439/676 |
| 6,997,750 | B2 | | 2/2006 | Johannes et al. | 439/620 |
| 7,229,324 | B2 | | 6/2007 | Van Der Steen | 439/682 |

* cited by examiner

*Primary Examiner*—Tho D Ta
(74) *Attorney, Agent, or Firm*—Harrington & Smith

(57) ABSTRACT

An electrical terminal including a first connection section; and a second connection section. The second connection section includes at least two cantilevered deflectable contact arms configured to contact a mating electrical terminal. A front end of each of the arms is outwardly flared including opposite sides of each front end being outwardly flared in general opposite directions relative to each other. The front ends combine to form a general tulip shaped entrance into the electrical terminal for the mating electrical terminal.

19 Claims, 9 Drawing Sheets

ELECTRICAL CONNECTOR WITH CONTACT ARM PRELOADING

CROSS REFERENCE TO RELATED APPLICATION

This application claims priority under 35 U.S.C. §119(e) on U.S. Provisional Patent Application No. 61/063,276 filed Jan. 31, 2008 which is hereby incorporated by reference in its entirety.

BACKGROUND OF THE INVENTION

1. Field of the Invention

The invention relates to an electrical connector and, more particularly, to interaction between an electrical contact terminal and a housing of the connector.

2. Brief Description of Prior Developments

U.S. Pat. No. 7,229,324 discloses an electrical connector with a housing having V-shaped preload ridges provided with support extensions. U.S. Pat. No. 6,997,750 discloses a contact with a ferrite tube.

SUMMARY

The following summary is merely intended to be exemplary. The summary is not intended to limit the scope of the claimed invention.

In accordance with one aspect of the invention, an electrical terminal is provided including a first connection section; and a second connection section. The second connection section includes at least two cantilevered deflectable contact arms configured to contact a mating electrical terminal. A front end of each of the arms is outwardly flared including opposite sides of each front end being outwardly flared in general opposite directions relative to each other. The front ends combine to form a general tulip shaped entrance into the electrical terminal for the mating electrical terminal.

In accordance with one aspect of the invention, an electrical connector housing is provided comprising a terminal receiving area configured to receive a female electrical terminal therein; a mating terminal entrance into the terminal receiving area; and a guidance feature located at the mating terminal entrance and extending into the terminal receiving area. The guidance feature comprises a general volcano shape with a through hole at the mating terminal entrance and a general cone shaped exterior surface configured to contact and spread ends of arms of the female electrical terminal in the terminal receiving area.

In accordance with one aspect of the invention, a method of manufacturing an electrical connector is provided comprising forming a housing comprising a terminal receiving area configured to receive a female electrical terminal therein; a mating terminal entrance into the terminal receiving area; and a guidance feature located at the mating terminal entrance and extending into the terminal receiving area, wherein the guidance feature comprises a general volcano shape with a through hole at the mating terminal entrance and a general cone shaped exterior surface; and inserting the female electrical terminal into the terminal receiving area.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENT

Figure 1:
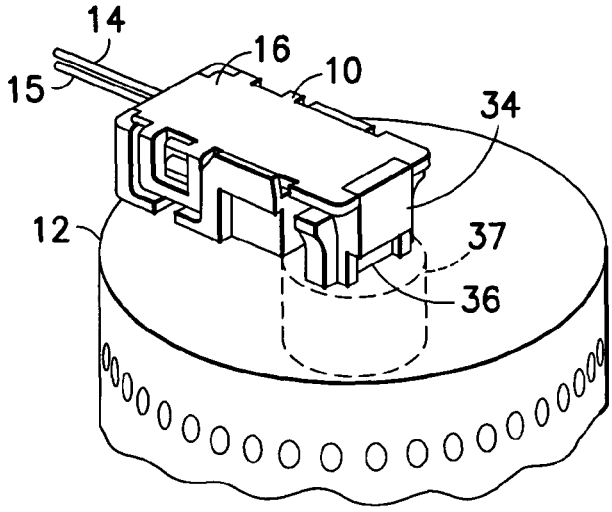
FIG. 1 is a perspective view of an electrical connector comprising features of the invention connected to a gas generator.

Referring to FIG. 1, there is shown a perspective view of an example electrical connector 10, incorporating features of the invention, shown attached to an air bag gas generator 12. In alternate embodiments, the connector 10 could be attached to any suitable type of gas generator or, to any other type of electrical or electronic component. Although the invention will be described with reference to the exemplary embodiments shown in the drawings, it should be understood that the present invention can be embodied in many alternate forms of embodiments. In addition, any suitable size, shape or type of elements or materials could be used.

Figure 2:
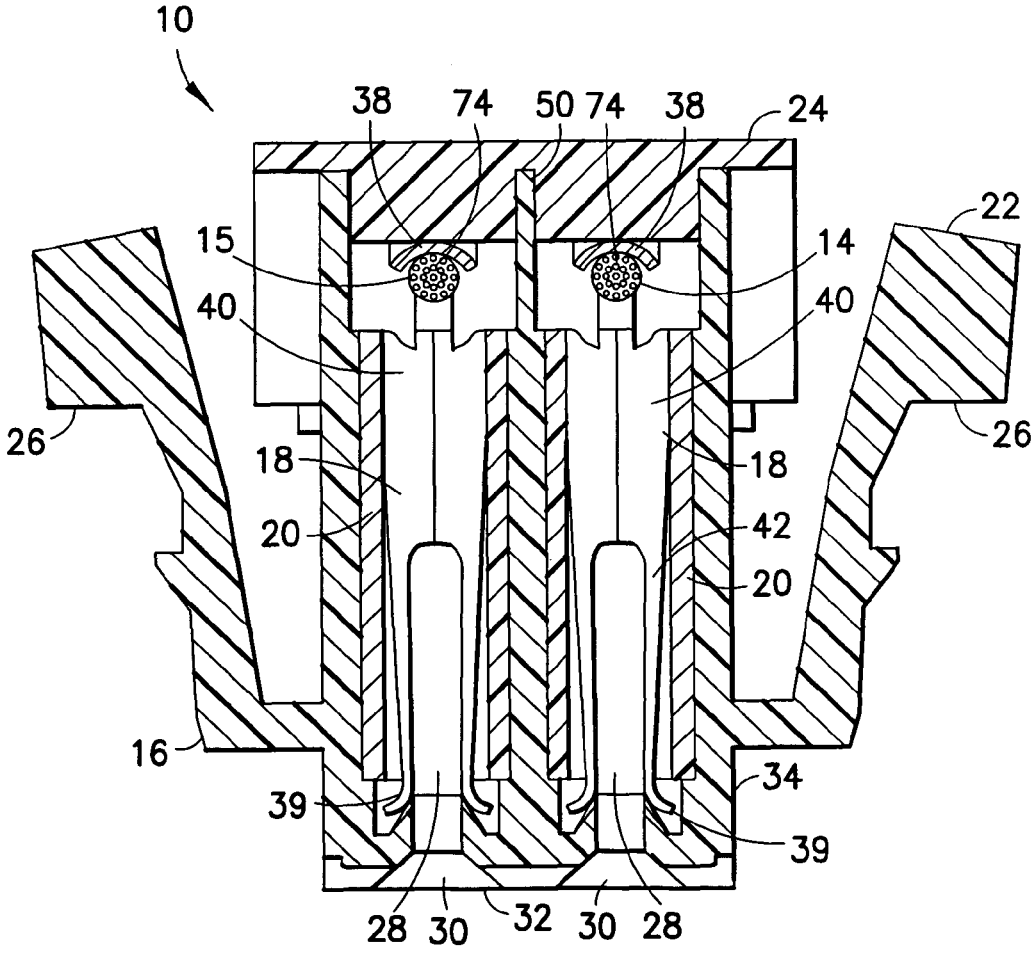
FIG. 2 is a cross sectional view of the connector shown in FIG. 1.

The connector 10, in this embodiment, is for use in connecting electrical conductors 14, 15 with an initiator 37 in the air bag gas generator 12. Referring also to FIG. 2, the connector 10 generally comprises a housing 16, electrical contact terminals 18 and tube-shaped ferrite hoods 20. However, in alternate embodiments, the connector could additionally comprise one or more filter assemblies. One type of filter assembly is described in U.S. Pat. No. 6,799,999 which is hereby incorporated by reference in its entirety. In an alternate embodiment, a filter assembly and/or ferrite hood might not be provided.

The housing 16 comprises a first housing piece 22 and a second housing piece 24. The two housing pieces are each preferably one-piece members comprised of molded plastic or polymer material. However, in alternate embodiments, any suitable material(s) could be used. In an alternate embodiment, the housing could be comprised of more or less than two housing pieces.

The first housing piece 22 includes two cantilevered finger actuatable deflectable latches 26, two separate receiving areas 28, and two holes 30 through a bottom face 32 of the housing into the receiving areas 28. However, in alternate embodiments, the latches 26 might not be provided. Alternatively, any suitable type of latching system could be provided. The housing 16, at the bottom of the front section 34, is adapted to be plugged into a socket 36 of the initiator 37 of the gas generator 12. The latches 26 are adapted to latch with latch surfaces in the socket 36. Optionally, additional connector position assurance means (not shown) can be provided to prevent the connector 10 from accidentally being disengaged from the gas generator 12. The second housing piece 24 is preferably snap lock mounted onto the first housing piece 22 after the contacts 18 and hoods 20 are located in the receiving areas 28. However, in alternate embodiments, any suitable type of connection could be provided. In addition, in alternate embodiments, other types of housings or housing components could be provided.

Figure 3:
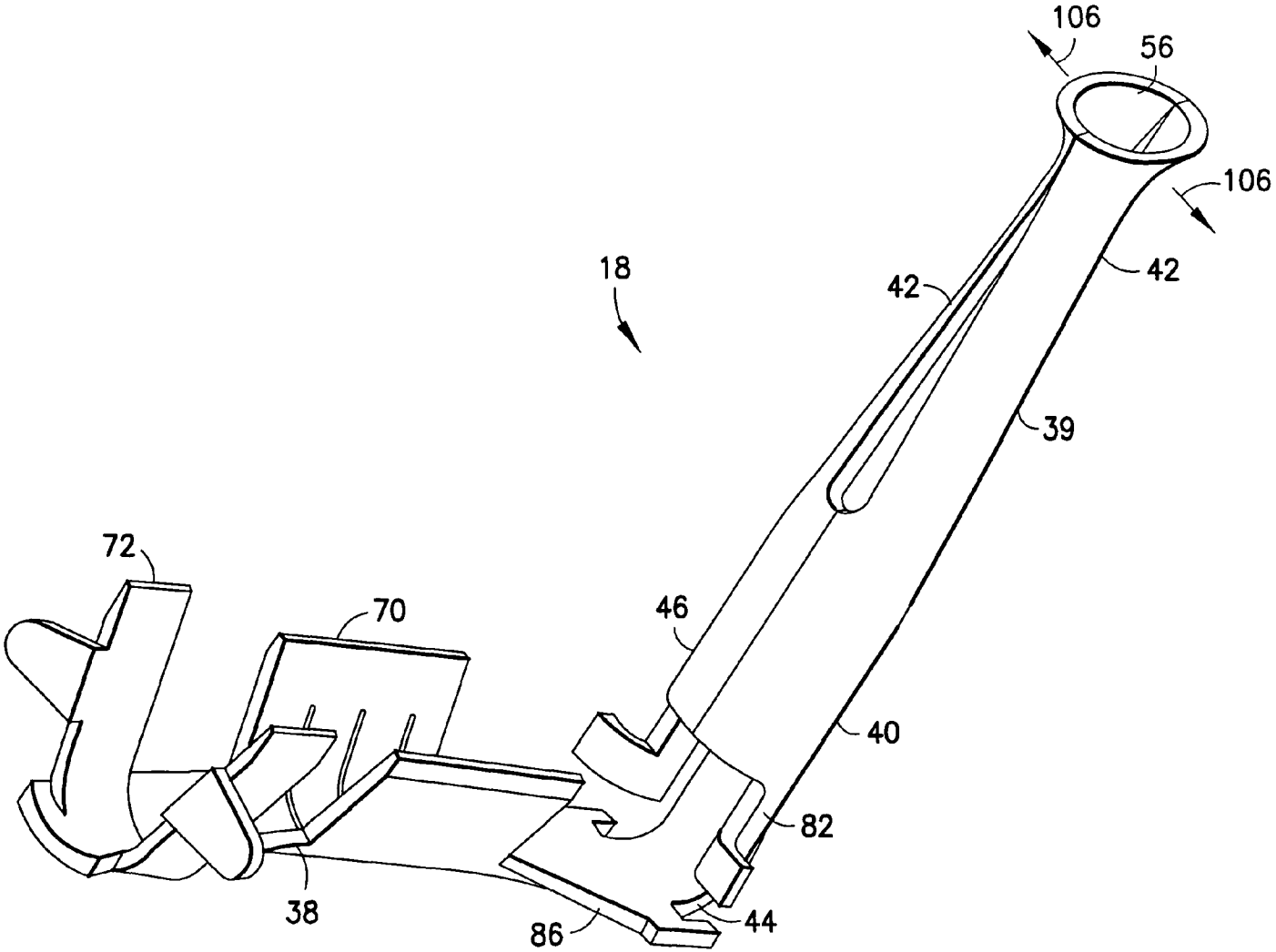
FIG. 3 is a perspective view of one of the electrical contacts used in the connector shown in FIG. 2.

Referring also to FIG. 3, the electrical contact terminals 18 each comprise a first connection section 38, a second female connection section 39, and a positioning section 40. Each first connection section 38 forms a wire connection section for one of the wires 14, 15. However, in alternate embodiments, the terminals 18 could comprise additional sections, or sections which are shaped differently from the shapes shown in the drawings. Preferably, the contact terminals 18 are one-piece members comprised of stamped and formed sheet metal. However, in alternate embodiments, the contact terminals could be comprised of any suitable material(s) and/or could be formed by any suitable contact manufacturing process.

The first connection section 38 is provided for forming a wire connection section or lead section for the contact terminal 18. The first connection sections 38 can be crimped onto respective ones of the electrical conductors 14, 15 for connecting the electrical conductors 14, 15 to the contact terminal 18. The wire connection section 38 includes a front portion 70 and a rear portion 72. The front portion 70 is crimped onto the conductor strands 74 of the wire 14 or 15. The rear portion 72 is crimped onto the outer electrical insulation of the wire 14 or 15. However, in alternate embodiments, the first connection section 38 could have any suitable shape. The conductors 14, 15 could be crimped, soldered or welded to the first connection section 38. In the embodiment shown, the first connection section 38 is angled about 90 degrees relative to the second connection section 39. However, the lead section could be straight for an in-line connector.

The second female connection section 39 generally comprises two spring contact arms 42. However, in alternate embodiments, the second female connection section could comprise more or less than two spring contact arms or, alternatively, could comprise any suitable type of female shaped connection section. The two spring contact arms 42 extend in a general cantilever fashion from the tube section 46 of the positioning section 40. In the embodiment shown, each spring contact arm 42 comprises a general curved cross-section and are substantially mirror images of each other. Thus, the second connection section 39 forms a general column shape. However, in alternate embodiments, the contact arms could have different shapes and/or could be different from each other.

The general tubular shape of the tube section 46 is coaxially aligned with the center axis of the second connection section 39. However, in alternate embodiments, the positioning section and the second connection section need not be coaxially aligned. The two spring contact arms 42 taper towards each other; towards their distal or front ends 56. The distal ends 56 flair outward to form a male contact entrance area. However, as noted above, in alternate embodiments the spring contact arms could comprise any suitable type of shape.

Figure 4:
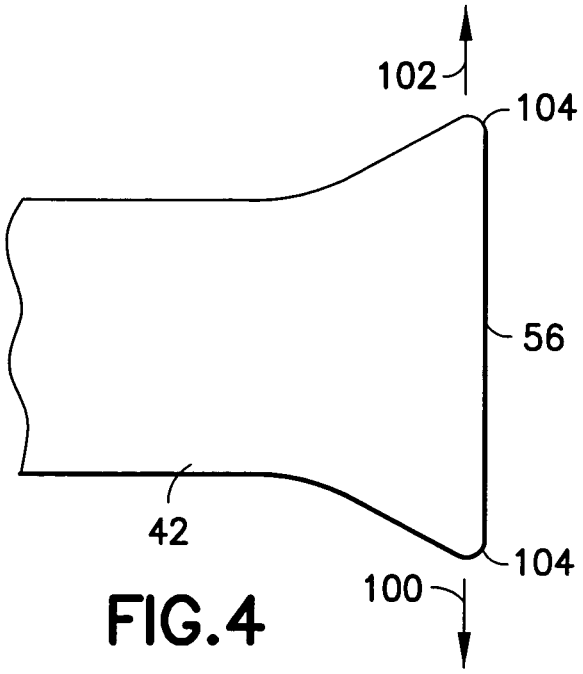
FIG. 4 is a side view of a front end of the electrical terminal shown in FIG. 3.
Figure 5:
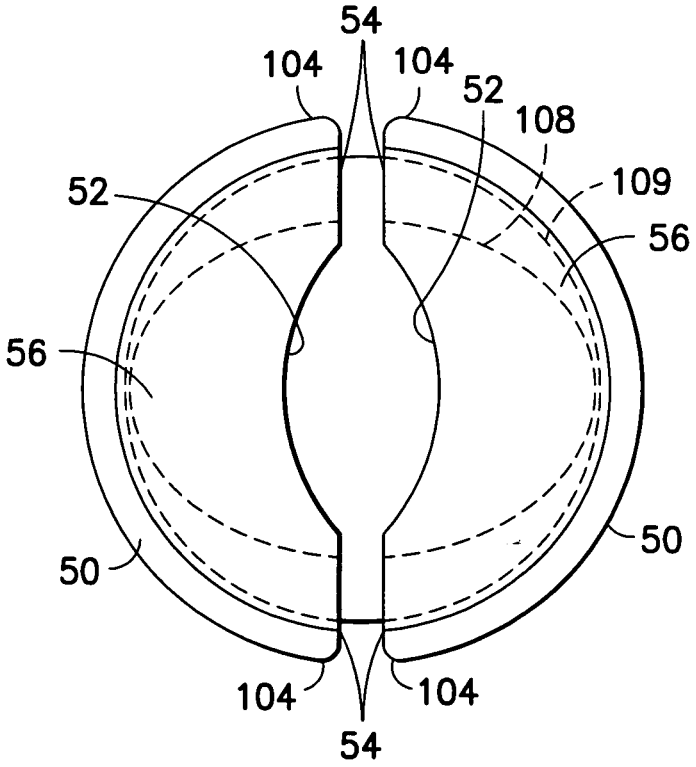
FIG. 5 is a plan view of the front end of the electrical terminal shown in FIG. 3.
Figure 6:
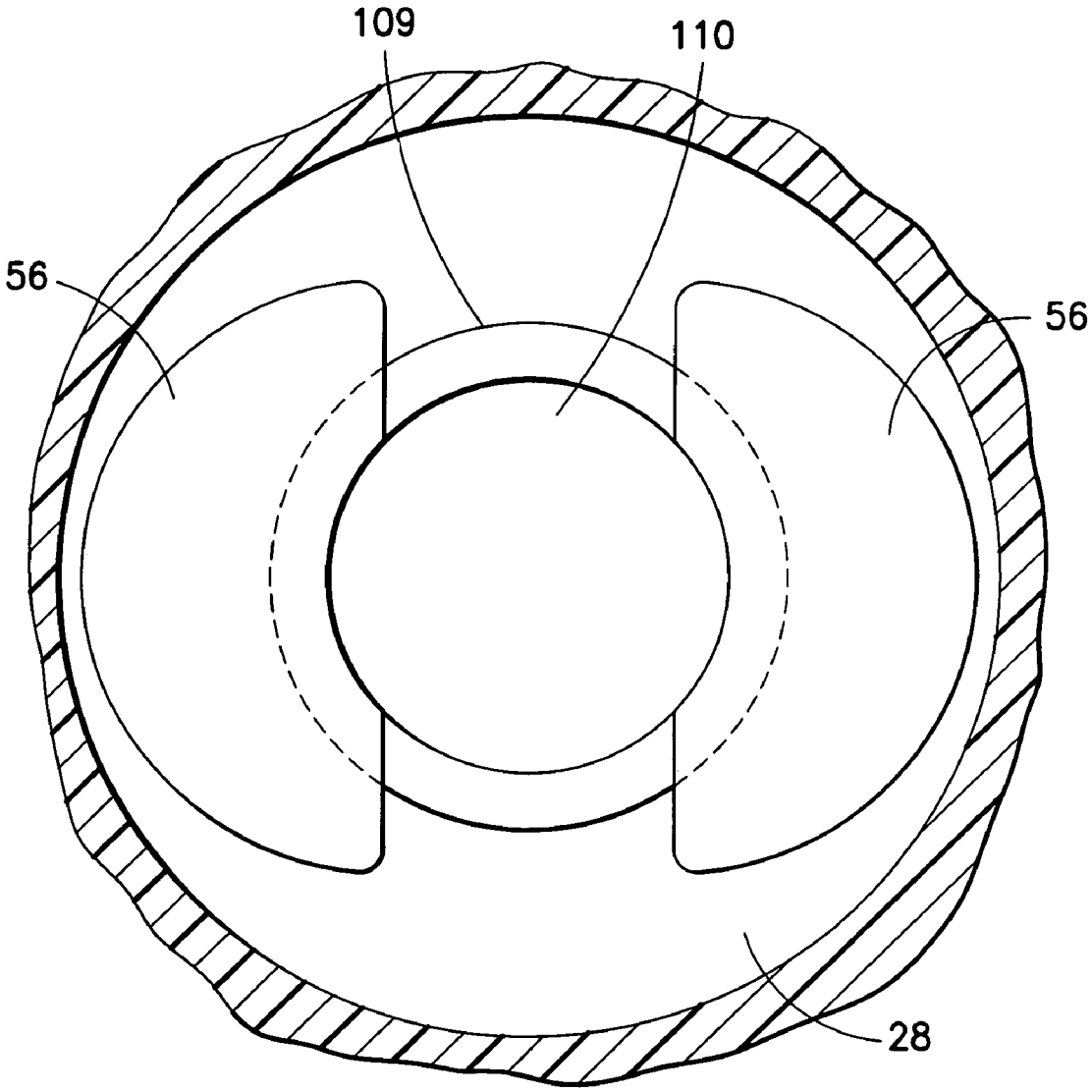
FIG. 6 is a partial cross sectional view of the electrical terminal shown in FIGS. 3-5 in the housing shown in FIG. 2 with a mating male pin inserted into the electrical terminal.

Referring also to FIG. 4, a side view of the front end 56 of one of the arms 42 is shown. As can be seen, the end 56 flares out in three directions. The end 56 flares out in first and second opposite directions 100, 102 at its lateral edges 104, and the two ends 56 flare out in opposite directions 106 shown in FIG. 3. FIG. 5 shows a front view of the front ends 56. The dotted lines illustrate the shape 108 of a conventional contact terminal front end for comparison. The lateral edges 104 extend outward past the outer diameter 109 of the positioning section 40 (also illustrated by the dotted line shape 108). FIG. 6 shows the ends 56 after a male pin 110 from a matting connector has been inserted.

The two front ends 56 combine to form a general bowl shape with a slot between the ends. Stated another way, the front end of each of the arms is outwardly flared, including opposite sides of each front end being outwardly flared in general opposite directions relative to each other, such that the front ends combine to form a general tulip shaped entrance into the electrical terminal for the mating electrical terminal. Each front end 56 has a general semi-circular outer edge 50 as seen best in FIG. 5. The front ends 56 slope downward and inward from the general semi-circular outer edge 50 to an interior generally crescent shaped inner side 52. However, flat edges 54 are provided also. As noted above, the front ends 56 form a general bowl shape with a slot therethrough. The outer edges 50 of the front ends 56 are larger than a diameter of the tube section 46 of the positioning section 40 of the second connection section. The front ends have a general bell shape side profile as seen best in FIG. 4.

Figure 8:
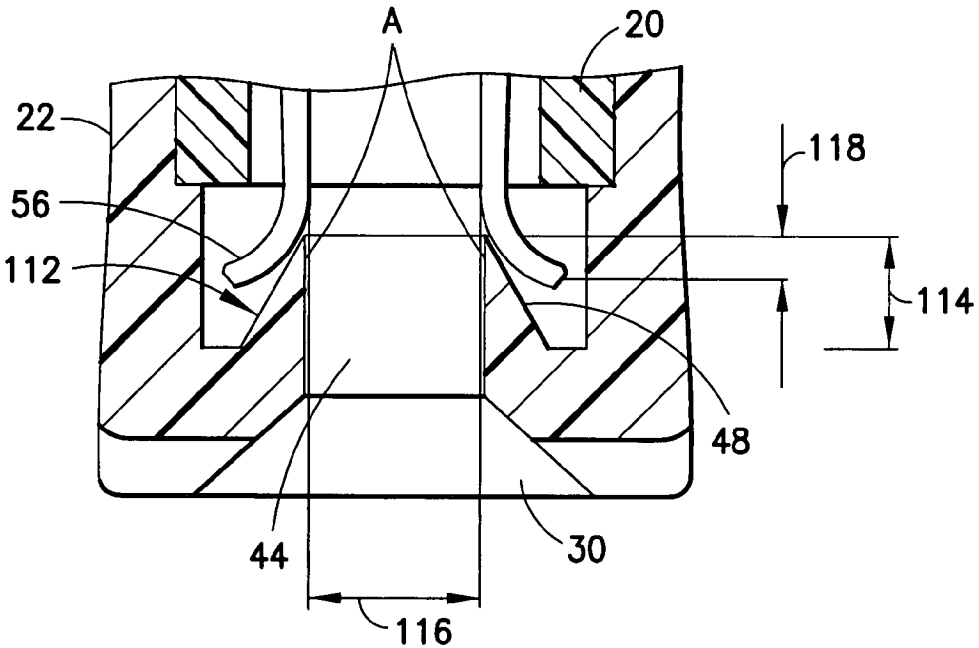
FIG. 8 is an enlarged view of a portion of the connector shown in FIG. 7.
Figure 7:
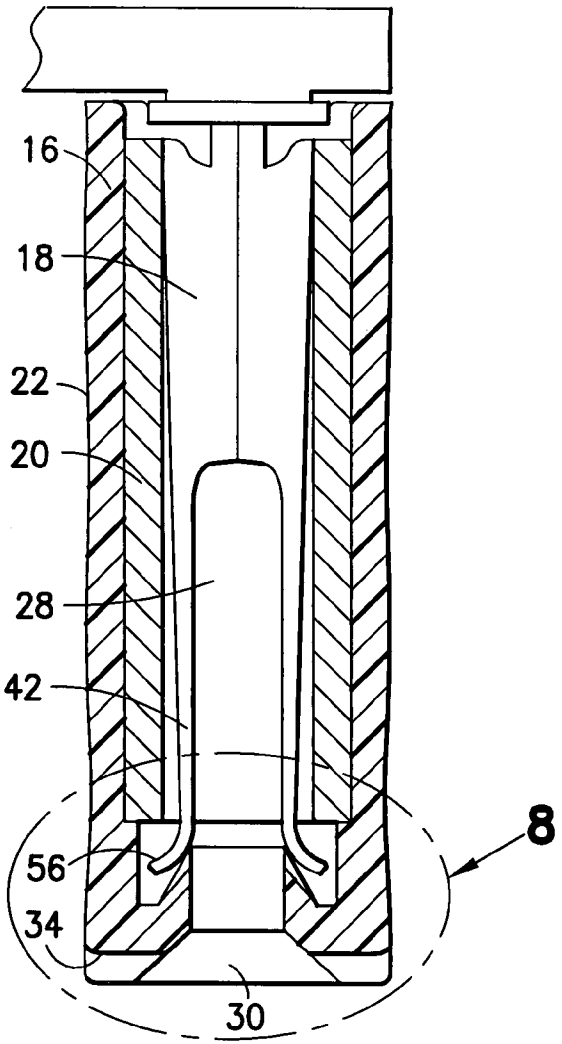
FIG. 7 is an enlarged partial cross sectional view of the connector shown in FIG. 2.
Figure 9:
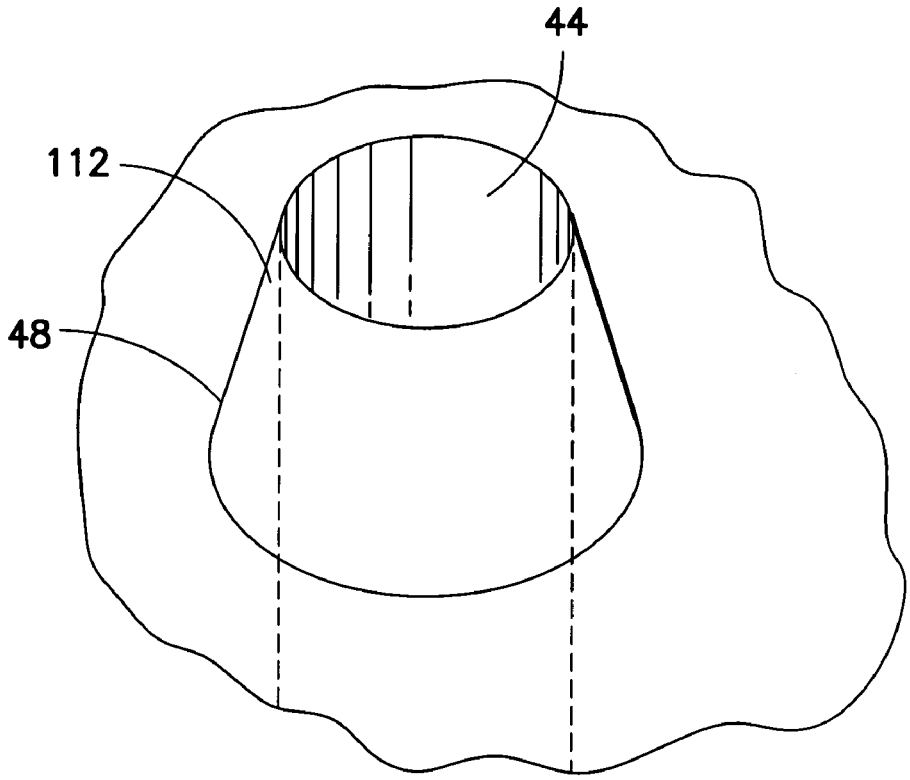
FIG. 9 is a partial perspective view of the guidance feature of the housing shown in FIGS. 7 and 8.

Referring also to FIGS. 7-9, the bottom of the front section 34 of the housing 16 has two guidance features 112; one in each receiving area 28. Each guidance feature 112 is located at a respective one of the holes 30. The guidance feature 112 has a general anthill shape or volcano shape. Each guidance feature 112 extends inward into a respective one of the receiving area 28 from the hole 30. The height 114 of the anthill feature 112 is extended by a distance 118; about 33 percent higher than previously contemplated. The increase size of the feature 112 is shown by area A. This results in the two arms 42 being spaced apart to provide a contact point gap 116 which is about 13 percent wider than previously contemplated. The larger size of the anthill feature 112 is accommodated by the ends 56 due to the laterally flared ends 104 (see FIG. 5) to enable the ends 56 to deflect outward from each other smoothly when the ends 56 are pre-loaded onto the anthill feature 112.

As seen best in FIG. 9, the shape of the feature 112 has a general volcano shape or anthill shape. The feature 112 has a through hole 44 at the mating terminal entrance 30 and a general cone shaped exterior surface 48. The exterior surface 48 is configured to contact and spread ends 56 of arms 42 of the female electrical terminal in the terminal receiving area 28. The general triangular or tulip shape terminal ends 56 sit on the exterior surface 48 as seen best in FIG. 8. In the embodiment shown, the cone shape of the exterior surface 48 is constant or swept 360 degrees around the center axis of the hole 44. However, in alternate embodiments there could be a discontinuity.

The new laterally flared shape of the ends 56 insure very accurate seating of the ends 56 on the anthill feature 112 to insure proper insertion of the male pin 110 between the arms 42 without problems. More specifically, this provides better terminal alignment of the front end of the contact 18 in the receiving area 28 of the housing 16 and, thus, better terminal alignment of the male pin 110 with the contact 18. The anthill feature 112, forms a housing guidance feature that cooperates with the flared ends 56 which form a terminal guidance feature. The housing guidance feature and the terminal guidance feature cooperate with each other to provided better terminal-to-housing alignment.

Figure 10:
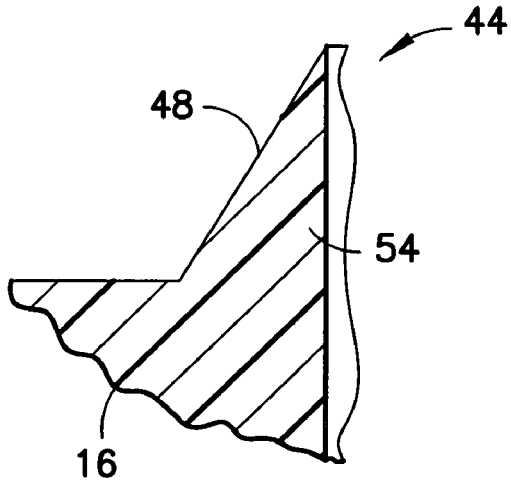
FIG. 10 is a partial cross sectional view of the guidance feature shown in FIG. 9.

Referring also to FIG. 10, the triangular cross sectional shape of the wall 54 of the feature 112 is swept around the axis of the hole 44, but terminates at tangent points of the through hole 44 with the sides that are terminated being parallel with the center plane through the locking legs.

Figure 11:
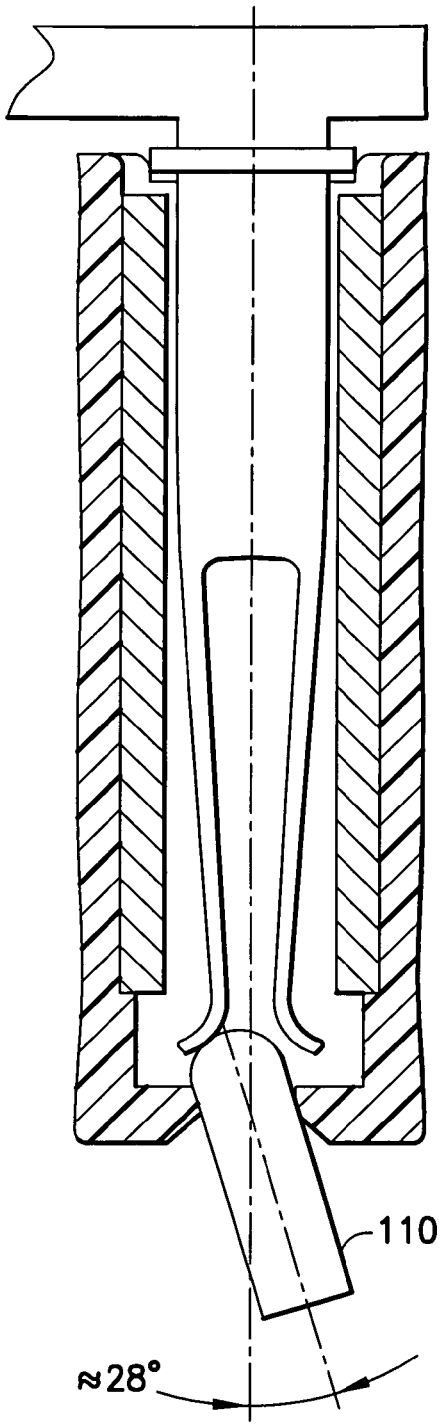
FIG.11 PRIOR ART
FIG. 11 is a partial cross sectional view of a prior art electrical connector showing a male pin being inserted at a maximum insertion angle.
Figure 12:
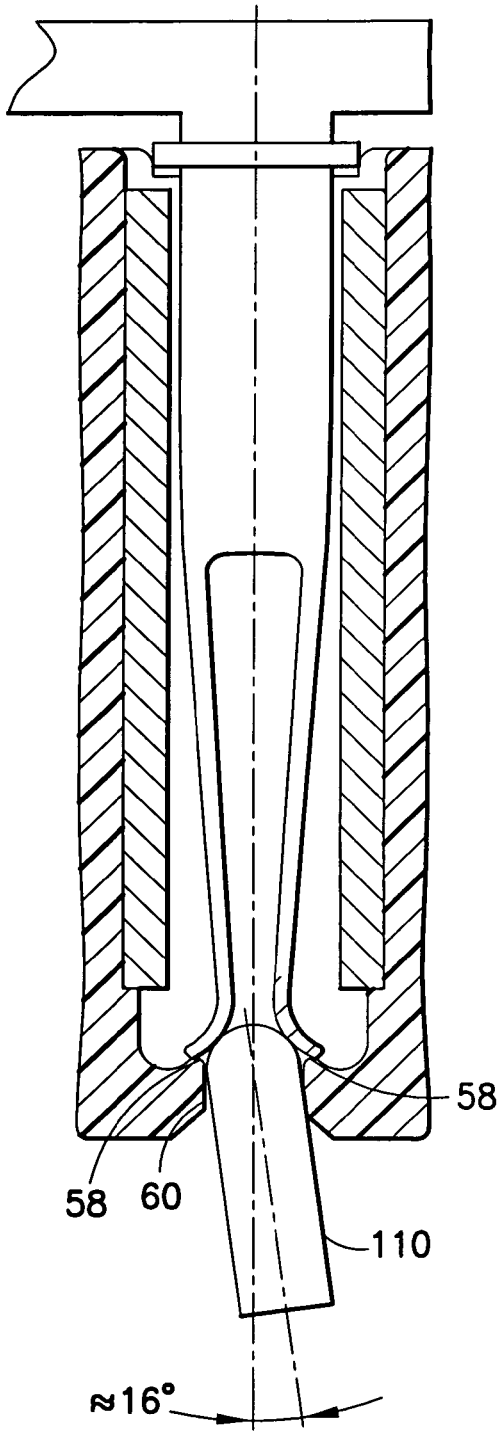
FIG.12 PRIOR ART
FIG. 12 is a partial cross sectional view of another prior art electrical connector showing a male pin being inserted at a maximum insertion angle.
Figure 13:
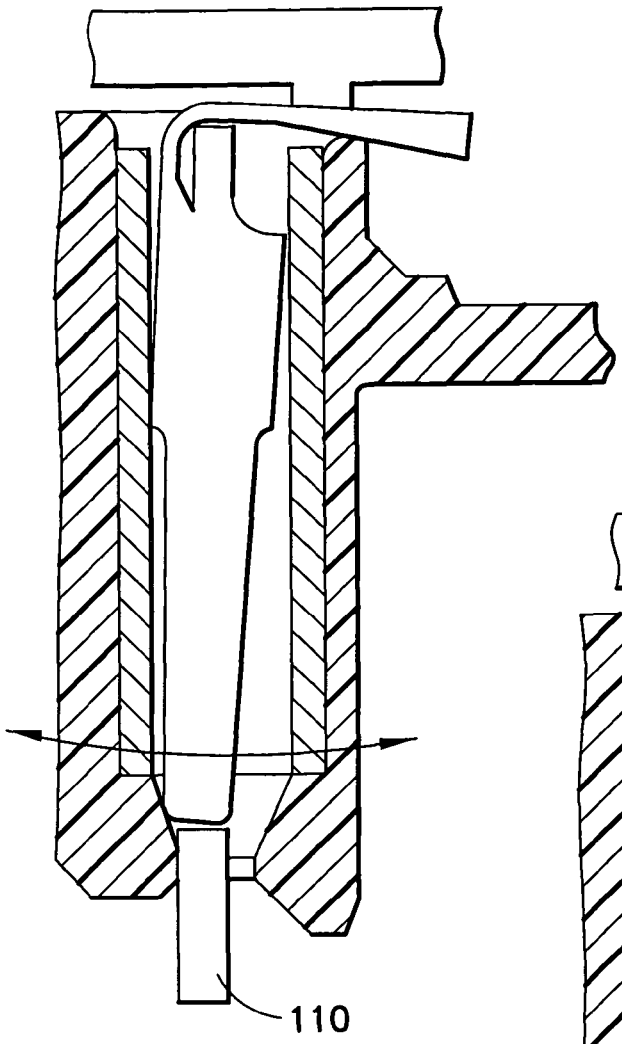
FIG. 13 PRIOR ART
FIG. 13 is a cross sectional view of the electrical connector shown in FIG. 11.
Figure 14:
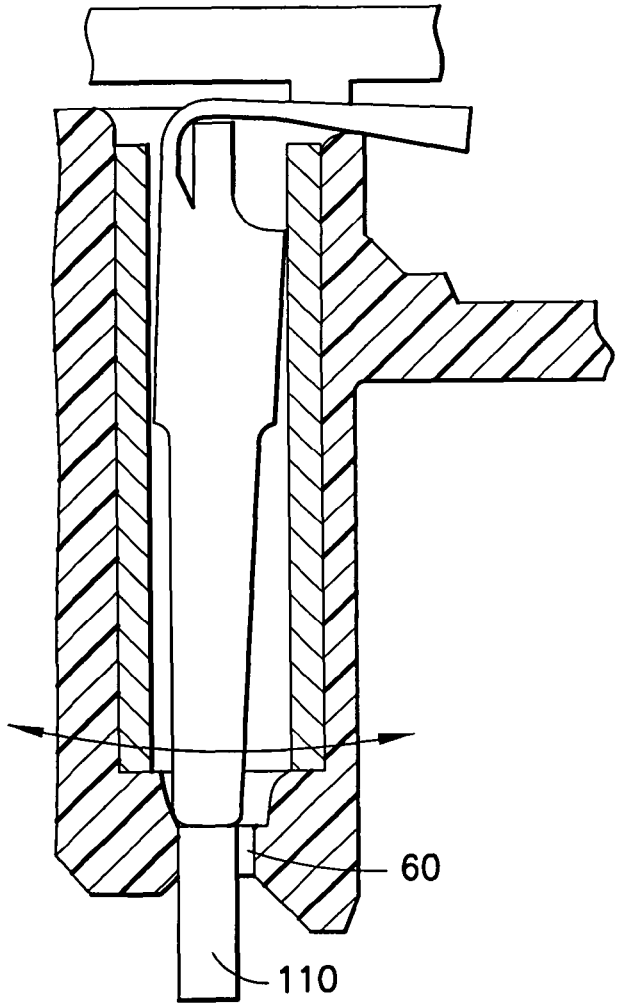
FIG. 14 PRIOR ART
FIG. 14 is a cross sectional view of the electrical connector shown in FIG. 12.

FIGS. 11 and 13 show a design of an ABX-3 electrical connector manufactured by FCI. The pin entry angle for the male terminal is about 28 degrees. FIGS. 12 and 14 show a design of an ABX-3.5 electrical connector manufactured by FCI. The pin entry angle for the male terminal is about 16 degrees. The ABX-3.5 electrical connector has two extensions 58 at the male pin entry hole which decreases the possible entry angle of the male pin 110. This reduces the amount of pin beam slide loading which might occur during mating. However, as seen in FIG. 14, the extensions do not extend all the way around the hole 60. Also as seen in FIG. 14, the hole 60 of the ABX-3.5 has steeper walls than the ABX-3 to keep the contact arms more central when moving forwards and backwards.

Figure 15:
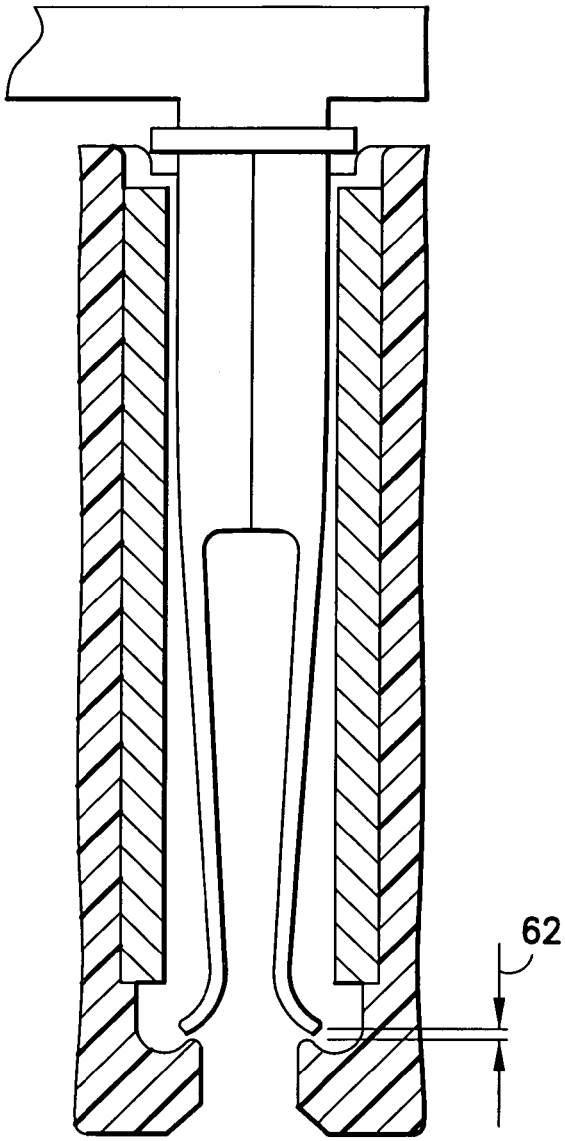
FIG. 15 PRIOR ART
FIG. 15 is a cross sectional view of the electrical connector shown in FIG. 12 before the male pin is inserted.
Figure 16:
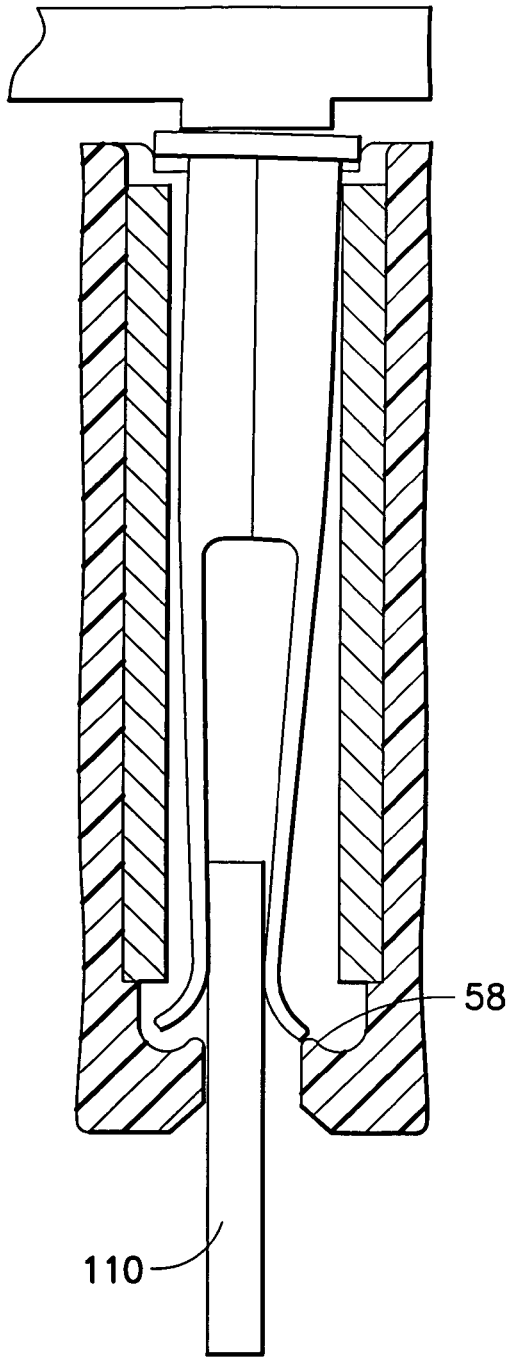
FIG. 16 PRIOR ART
FIG. 16 is a cross sectional view of the electrical connector shown in FIG. 15 after the male pin is fully inserted.

The anthill feature 112 of the present invention is taller in height than the extensions 58; about 33 percent taller, and can provide preloading of the contact arms 42 against the housing on the anthill feature 112. Preloading is not provided in the ABX-3 and an ABX-3.5 electrical connectors. However, preloading need not be provided. In addition, the shapes of the housing guidance feature and the terminal guidance feature of the present invention provide dependable and repeatable terminal-to-housing alignment which was not as effectively provided by the ABX-3 and an ABX-3.5 electrical connectors. These figures illustrate the problems associated with contact alignment and how the female contact could otherwise tilt or shift inside the receiving area 28. In the ABX-3.5 electrical connectors, as shown in FIGS. 15 and 16, a clearance 62 was provided between the ends of the contact and the housing. One end of one arm of the female contact can contact the extension 58 after the pin 110 is inserted. With the invention, no clearance is provided. The ends 56 of the contact can contact the anthill feature at all times until the male pin 110 is inserted; at which point the ends 56 are spread apart further.

With the present invention, the pin entry angle for the male terminal can be less than 16 degrees; because the feature 112 is taller than the extensions 58. The feature 112 also restricts the amount of beam swing in the receiving area 28 by eliminating the gap between the ends 56 and the housing at the feature 112 that previously existed with the ABX-3.5. This results in a more centralized contact gap. When the male pin 110 is removed, the ends 56 of the terminal 18 automatically re-seat in a preloaded position on the feature 112 without the male pin 110 needing to pull the terminal 18 onto the feature 112. In the ABX-3.5, friction from the withdrawing male pin 110 pulled the female terminal down towards the entrance.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. An electrical terminal comprising:

a first connection section; and a second connection section which is connected to the first connection section, wherein the second connection section comprises at least two cantilevered deflectable contact arms configured to contact a mating electrical terminal, wherein a front end of each of the arms is outwardly flared in three directions generally orthogonal to one another and including opposite sides of each front end being outwardly flared in general opposite directions relative to each other, wherein the front end of each of the arms has a general semi-circular outer edge and generally parallel flat edges at opposite ends of the semi-circular outer edge, and wherein the front ends combine to form a general tulip shaped entrance into the electrical terminal for the mating electrical terminal.

2. An electrical terminal as in claim 1 wherein the front end slopes downward and inward from the general semi-circular outer edge to an interior generally crescent shaped inner side.

3. An electrical terminal as in claim 1 wherein the front ends form a general bowl shape with a straight slot therethrough.

4. An electrical terminal as in claim 1 wherein the second connection section is angled relative to the first connection section at an angle of about 90 degrees.

5. An electrical terminal as in claim 1 wherein the front ends have a general bell shape side profile.

6. An electrical terminal comprising:

a first connection section; and a second connection section which is connected to the first connection section, wherein the second connection section comprises at least two cantilevered deflectable contact arms configured to contact a mating electrical terminal, wherein a front end of each of the arms is outwardly flared including opposite sides of each front end being outwardly flared in general opposite directions relative to each other, wherein the front ends combine to form a general tulip shaped entrance into the electrical terminal for the mating electrical terminal, and wherein outer edges of the front ends are larger than a diameter of a positioning section of the second connection section.

7. An electrical connector comprising:

an electrical connector housing having a terminal receiving area; and an electrical terminal as in claim 1 located in the terminal receiving area.

8. An electrical connector as in claim 7 wherein the housing comprises a guidance feature located at an entrance into the terminal receiving area and extending into the terminal receiving area, wherein the guidance feature comprises a general volcano shape with a through hole at the entrance and a general outwardly sloping shaped exterior surface, wherein the front ends of the arms contact the exterior surface and are spread apart in the terminal receiving area by the guidance feature.

9. An electrical connector housing comprising:

a terminal receiving area configured to receive a female electrical terminal therein;

a mating terminal entrance into the terminal receiving area; and a guidance feature located at the mating terminal entrance and extending into the terminal receiving area, wherein the guidance feature comprises a general volcano shape with a through hole at the mating terminal entrance and a general cone shaped exterior surface configured to contact and spread ends of arms of the female electrical terminal in the terminal receiving area.

10. An electrical connector housing as in claim 9 wherein the exterior surface of the volcano shape extends about 360 degrees about a center axis of the through hole.

11. An electrical connector housing as in claim 9 wherein the exterior surface has a constant slope.

12. An electrical connector comprising:

an electrical connector housing as in claim 9; and a female electrical terminal extending into the terminal receiving area, wherein the female electrical terminal comprises at least two cantilevered deflectable contact arms configured to contact a mating electrical terminal, wherein a front end of each of the arms is outwardly flared including opposite sides of each front end being outwardly flared in general opposite directions relative to each other, and wherein the front ends combine to form a general bowl shaped entrance into the electrical terminal for the mating electrical terminal with a slot between the front ends.

13. An electrical connector as in claim 12 wherein outer edges of the front ends are larger than a diameter of a positioning section of the female electrical terminal.

14. An electrical connector as in claim 12 wherein the front ends have a general bell shaped side profile.

15. An electrical connector as in claim 12 wherein each front end has a general semi-circular outer edge.

16. An electrical connector as in claim 15 wherein the front end slopes downward and inward from the general semi-circular outer edge to an interior generally crescent shaped inner side.

17. A method of manufacturing an electrical connector comprising:

forming a housing comprising:

a terminal receiving area configured to receive a female electrical terminal therein;

a mating terminal entrance into the terminal receiving area; and a guidance feature located at the mating terminal entrance and extending into the terminal receiving area, wherein the guidance feature comprises a general volcano shape with a through hole at the mating terminal entrance and a general cone shaped exterior surface; and inserting the female electrical terminal into the terminal receiving area.

18. A method as in claim 17 wherein inserting the female electrical terminal into the terminal receiving area comprises spreading cantilever contact arms of the terminal apart by contact with the guidance feature to thereby preload the arms on the guidance feature.

19. An electrical connector comprising:

an electrical connector housing having a terminal receiving area and an electrical terminal located in the terminal receiving area, wherein the electrical terminal comprises:

a first connection section; and a second connection section which is connected to the first connection section, wherein the second connection section comprises at least two cantilevered deflectable contact arms configured to contact a mating electrical terminal, wherein a front end of each of the arms is outwardly flared in three directions generally orthogonal to one another and including opposite sides of each front end being outwardly flared in general opposite directions relative to each other, and wherein the front ends combine to form a general tulip shaped entrance into the electrical terminal for the mating electrical terminal;

wherein the housing comprises a guidance feature located at an entrance into the terminal receiving area and extending into the terminal receiving area, wherein the guidance feature comprises a general volcano shape with a through hole at the entrance and a general outwardly sloping shaped exterior surface.

* * * * *